US007874875B2

(12) United States Patent
Chang

(10) Patent No.: US 7,874,875 B2
(45) Date of Patent: Jan. 25, 2011

(54) ELECTRICAL CONNECTOR

(75) Inventor: Wen Chang Chang, Keelung (TW)

(73) Assignee: Lotes Co., Ltd., Keelung (TW)

( * ) Notice: Subject to any disclaimer, the term of this patent is extended or adjusted under 35 U.S.C. 154(b) by 74 days.

(21) Appl. No.: 12/292,902

(22) Filed: Dec. 1, 2008

(65) Prior Publication Data

US 2010/0062630 A1 Mar. 11, 2010

(30) Foreign Application Priority Data

Sep. 7, 2008 (CN) ..... 2008 2 0134133

(51) Int. Cl.
*H01R 12/00* (2006.01)

(52) U.S. Cl. ..... 439/634; 439/637; 439/717

(58) Field of Classification Search ..... 439/634, 439/637, 717
See application file for complete search history.

(56) References Cited

U.S. PATENT DOCUMENTS 4,550,959 A * 11/1985 Grabbe et al. ..... 439/33
4,993,965 A * 2/1991 Eck ..... 439/374
5,013,263 A * 5/1991 Gordon et al. ..... 439/630
5,326,285 A * 7/1994 Maros ..... 439/717
5,584,728 A * 12/1996 Cheng ..... 439/637
5,822,855 A * 10/1998 Szczesny et al. ..... 29/883
5,980,282 A * 11/1999 Cheng ..... 439/157
6,431,920 B1 * 8/2002 Endres et al. ..... 439/717
7,472,477 B2 * 1/2009 Beaman et al. ..... 29/840
7,484,978 B1 * 2/2009 Gao ..... 439/160

* cited by examiner

*Primary Examiner*—Xuong M Chung Trans
(74) *Attorney, Agent, or Firm*—Rosenberg, Klein & Lee

(57) ABSTRACT

An electrical connector for electrically connecting an element to a circuit board includes at least two adjacent insulation bodies, a plugging slot located on the insulation bodies for being plugged with the element, and a set of conductive terminals disposed on the insulation bodies and electrically connected with the circuit board. One side of each of the insulation bodies is movably connected with the adjacent insulation body. When the circuit board undergoes soldering process, the relation position of the insulation bodies at the adjacent location is automatically adjusted according to the warp caused by the high temperature of soldering so as to reduce the warp and deformation. Thereby, the soldering portion of each conductive terminal received in the insulation bodies can be soldered onto the circuit board well, such that electrical connector is normally and electrically connected with the circuit board.

19 Claims, 10 Drawing Sheets

ELECTRICAL CONNECTOR

BACKGROUND OF THE INVENTION

1. Field of the Invention

The present invention relates to an electrical connector.

2. Description of Related Art

Conventionally, an electrical connector may be used for connecting the memory unit to the motherboard of the computer. The electrical connector includes an insulation body and a plurality of conductive terminals. Two ends of the insulation body are respectively disposed with an ejecting device that pivots. The insulation body also has a plugging slot for being plugged with the memory unit. Two sides of the plugging slot have a plurality of receiving slots that pass through the insulation body. The conductive terminals are received in the receiving slots. Because the electrical connector adopts the wave soldering technique for soldering, the circuit board needs to be disposed with a plurality of holes for the conductive terminals so that the conductive terminals may pass through the insulation body and enter into the holes to be soldered with the circuit board. However, because the wave soldering technique needs a lot of holes, the circuit layout of the circuit board becomes complex. Furthermore, when the conductive terminals are tightly disposed and soldered on the circuit board, high frequency cross-talk problem occurs to affect the transmission for the high frequency signal.

In order to improve this problem, the surface mount technology (SMT) is developed—it uses a set of automatic assembly equipment to directly paste and solder the surface assembly elements to the circuit board. The conductive terminals of the electrical connector are soldered and fastened on the circuit board via SMT. However, this solder technology is operated using a higher temperature than the wave soldering technique. As shown in FIG. 1, the electrical connector is located on the circuit board 100, and includes an insulation body 200, a plurality of conductive terminals 300 received and fastened on the insulation body 200, and two ejecting devices 400 disposed pivotedly at the two ends of the insulation body 200. The end of the conductive terminal 300 has a soldering portion 301 that are mounted on the surface of the circuit board 100. When the electrical connector is heated to be soldered onto the circuit board 100, the insulation body 200 will be warped and deformed due to the high temperature. Because the magnitude of the warp of the two ends of the insulation body 200 is large, the soldering portions 301 of part of the conductive terminals 300 received in the insulation body 200 cannot be maintained in the same plane. Therefore, the soldering portions 301 of part of the conductive terminals 300 cannot receive the adequate tin so that the fake-solder problem of faulty connection occurs. Thereby the conventional electrical connector is not soldered with the circuit board 100 well.

Therefore, it is necessary to design a novel electrical connector to overcome the above-mentioned problems.

SUMMARY OF THE INVENTION

One particular aspect of the present invention is to provide an electrical connector. The relation position (i.e. relative position) of at least two adjacent insulation bodies of the electrical connector that are movably connected can be adjusted to ensure the conductive terminals be soldered with the circuit board well, such that electrical connector is normally and electrically connected with the circuit board.

The electrical connector is used for electrically connecting an element to a circuit board. The electrical connector includes at least two adjacent insulation bodies, a plugging slot located on the insulation bodies for being plugged with the element, and a set of conductive terminals disposed on the insulation bodies and electrically connected with the circuit board. One side of each of the insulation bodies is disposed pivotedly with the adjacent insulation body.

The electrical connector is used for electrically connecting an element to a circuit board. The electrical connector includes at least two adjacent insulation bodies, a plugging slot located on the insulation bodies for being plugged with the element, and a set of conductive terminals disposed on the insulation bodies. One side of each of the insulation bodies is disposed pivotedly with the adjacent insulation body. The end of each of the conductive terminals has a soldering portion that is mounted on the circuit board. When the circuit board undergoes soldering process (such as SMT) so as to solder the soldering portions on the circuit board, the relation position of the insulation bodies at the adjacent location is automatically adjusted according to the warp caused by, high temperature to make each of the solder portions is soldered with the circuit board well.

The present invention has at least two adjacent insulation bodies on the electrical connector and one end of each insulation body is movably connected with the adjacent insulation body. When the soldering portions are mounted on the circuit board by the SMT (i.e. undergoing soldering process), the relation position of the insulation bodies at the adjacent location is automatically adjusted according to the warp caused by high temperature to reduce the warp and deformation. Thereby, the soldering portion of each conductive terminal received in the insulation bodies can be soldered onto the circuit board well. The electrical connector is normally and electrically connected with the circuit board.

For further understanding of the present invention, reference is made to the following detailed description illustrating the embodiments and examples of the present invention. The description is for illustrative purpose only and is not intended to limit the scope of the claim.

BRIEF DESCRIPTION OF THE DRAWINGS

The drawings included herein provide a further understanding of the present invention. A brief introduction of the drawings is as follows.

DETAILED DESCRIPTION OF PREFERRED EMBODIMENTS

Figure 1:
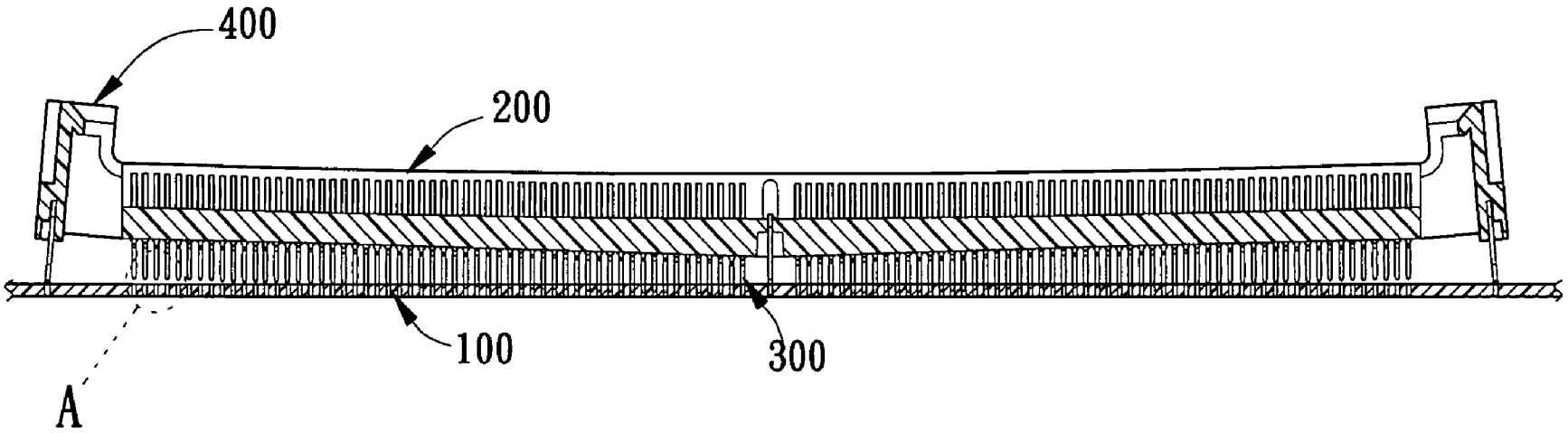
FIG. 1 PRIOR ART
FIG. 1 is a schematic diagram of the warp when a conventional electrical connector is heated and soldered onto the circuit board.
Figure 1A:
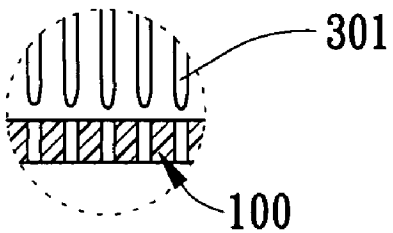
FIG. 1A PRIOR ART
FIG. 1A is a drawing of partial enlargement illustrating the electrical connector as shown in FIG. 1.

Reference is made to FIGS. 2-11A. The electrical connector is used for electrically connecting an element 6 and a circuit board 5, and includes a first insulation body 1, a second insulation body 2 disposed pivotedly with the first insulation body 1, a plugging slot 7 located on the first insulation body 1 and the second insulation body 2, a set of conductive terminals 3 disposed on the first insulation body 1 and the second insulation body 2 and two ejecting devices 4 disposed pivotedly with the first insulation body 1 and the second insulation body 2. In order to clearly display the figures, FIGS. 2-10 show part of the conductive terminals 3. Of course, the electrical connector of the present invention can includes three insulation bodies or more than three, and the number of the ejecting device 4 can also be one, three, or more than three.

Figure 2:
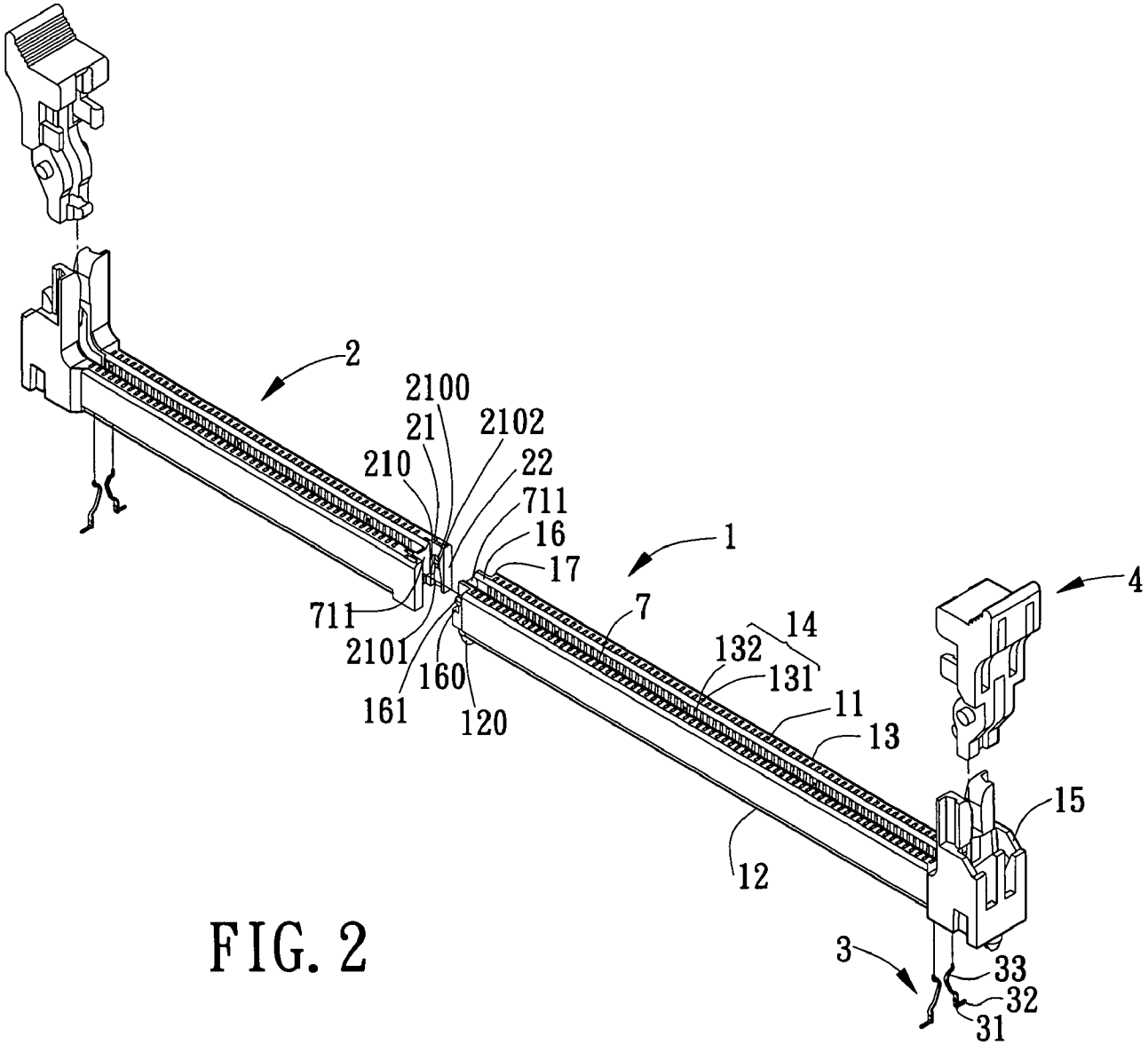
FIG. 2 is an exploded perspective view of the electrical connector of the present invention.
Figure 3:
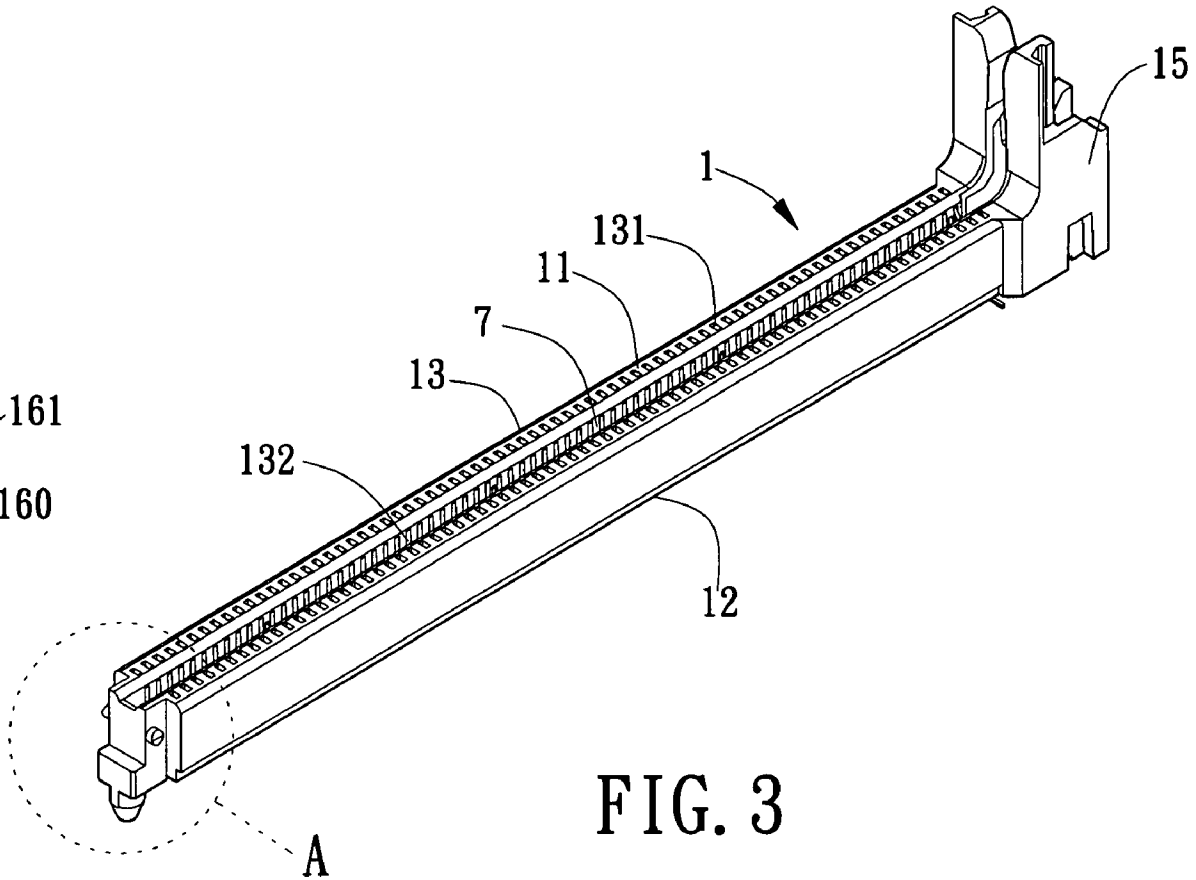
FIG. 3 is a perspective view of the first insulation body of the electrical connector of FIG. 2.
Figure 3A:
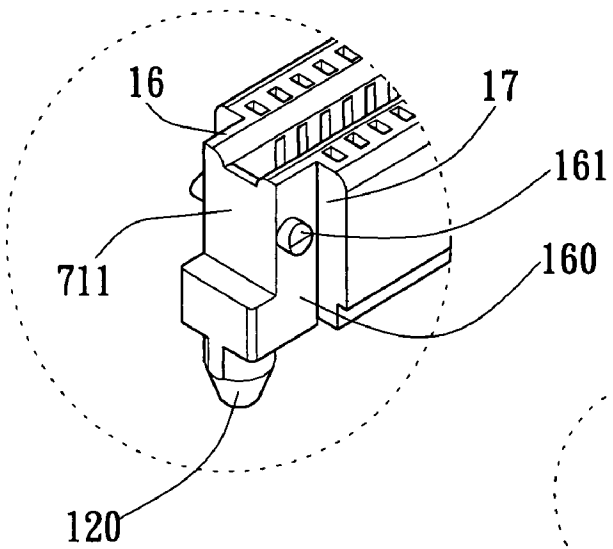
FIG. 3A is a drawing of partial enlargement illustrating the electrical connector as shown in FIG. 3.
Figure 4A:
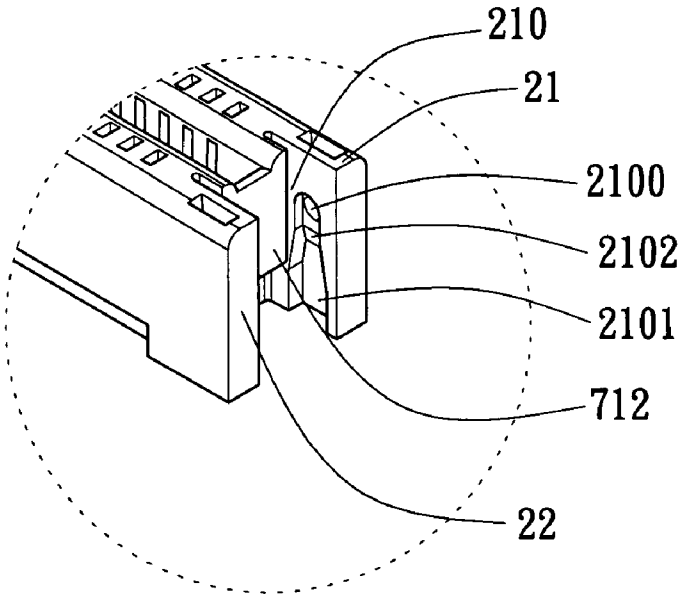
FIG. 4A is a drawing of partial enlargement illustrating the electrical connector as shown in FIG. 4.
Figure 4:
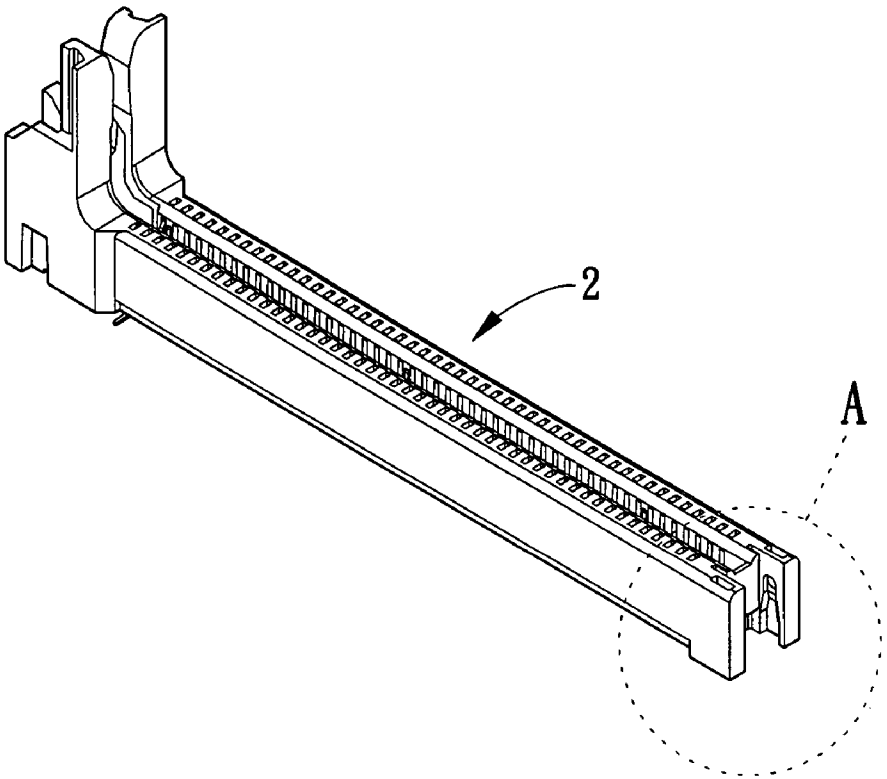
FIG. 4 is a perspective view of the second insulation body of the electrical connector of FIG. 2.

Reference is made to FIGS. 2 and 3A. The first insulation body 1 is a rectangular body. The first insulation body 1 has an upper surface 11 and a lower surface 12 that is opposite to the upper surface 11. The center of the upper surface 11 of the first insulation body 1 has the plugging slot 7 that is disposed along the lengthwise direction. The two sides of the plugging slot 7 of the first insulation body 1 respectively have a side wall 13. A plurality of troughs 131 are formed on the side wall 13 from the upper surface 11, and a plurality of holes 132 are formed on the side wall 13. The holes 132 links with the troughs 131 to form the receiving slot 14. The receiving slot 14 passes through the upper surface 11 and the lower surface 12 of the first insulation body 1. The receiving slot 14 is used for receiving the conductive terminals 3. One side of the first insulation body 1 that is adjacent to the second insulation body 2 has a first pivoting portion 16. The first insulation body 1 is pivoted with the second insulation body 2 via the pivoting portion 16. In other words the first insulation body 1 is disposed pivotedly with the second insulation body 2. The pivoting portion 16 protrudes to form a wedging portion 160. Two sides of the wedging portion 160 respectively have a short shaft 161. The connection side of the first insulation body 1 and the second insulation body 2 extends to form a first blocking portion 17.

The two sides of the lower surface 12 of the first insulation body 1 respectively have a fastening portion 120. As shown in FIG. 2, the fastening portion 120 fastens the first insulation body 1 on the circuit board 5.

Another side of the first insulation body 1 has a supporting frame 15, and the supporting frame 15 and the first insulation body 1 are integrated into one piece.

Figure 5:
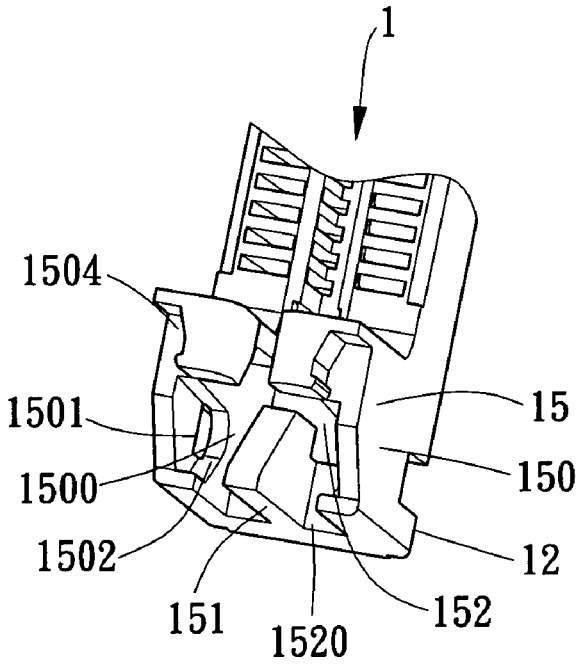
FIG. 5 is a schematic diagram of part of the first insulation body of the electrical connector of FIG. 2.

Reference is made to FIG. 5, the supporting frame 15 includes two side boards 150. The inner walls 1500 of the side boards 150 respectively indent outwards to form a pivoting hole 1501. There is a slot 152 between the two side boards 150. The slot 152 passes through the lower surface 12 of the first insulation body 1. The two sides of the positioning column 151 respectively have a receiving slot 1520. The receiving slot 1520 links with the slot 152. The inner walls 1500 of the two side boards 150 also indent outwards to form a guiding slot 1502. The guiding slot 1502 links with the pivoting hole 1501. The outer surface of the two side boards 150 also indents inwards to form a wedging slot 1504 for wedging the ejecting device 4.

Reference is made to FIGS. 4, 4A, 8, 8A, 9, and 9A, the length of the second insulation body 2 is different from the length of the first insulation body 1. The structure of the second insulation body 2 is similar to the first insulation body 1. The difference between the second insulation body 2 and the first insulation body 1 is that one side of the second insulation body 2 that is adjacent to the first insulation body 1 has a second pivoting portion 21 pivoted with the first pivoting portion 16. The width of the second pivoting portion 21 and the first pivoting portion 16 can be increased to the width of the second insulation body 2 or the first insulation body 1 to make the second insulation body 2 be firmly connected with the first insulation body 1 so as to increase the strength to withstand bumping. The second pivoting portion 21 indents to form a concave slot 210. The wedging portion 160 of the first insulation body 1 is received in the concave slot 210. The two opposite side walls of the concave slot 210 respectively indent to form a shaft slot 2100 for receiving and pivoting the short shaft 161 of the first insulation body 1. The lower surface of the second insulation body 2 indents to form a guiding slot 2101 for linking with the shaft slot 2100 along the concave slot 210. The guiding slot 2101 has a guiding slant surface 2102 so that the short shaft 161 of the first insulation body 1 can be easily installed in the shaft slot 2100 of the second insulation body 2. The connection side of the second insulation body 2 to the first insulation body 1 has a second blocking portion 22 for matching the first blocking portion 17 of the first insulation body 1 to prevent the first insulation body 1 and the second insulation body 2 from generating a huge relation movement. Thereby, when the first pivoting portion 16 of the first insulation body 1 is disposed pivotedly with the second pivoting portion 21 of the second insulation body 2, the first insulation body 1 and the second insulation body 2 can generate a relational pivoting rotation within a specific range. In this embodiment, one side of the second insulation body 2 is disposed pivotedly with the adjacent first insulation body 1 so that the goal of one side of the second insulation body 2 being movably connected with the adjacent first insulation body 1 may be achieved. In order to achieve this goal, in addition to pivot the second insulation body 2 with the first insulation body 1, one side of the second insulation body 2 is wedged with the adjacent first insulation body 1. In detail, one side of the first insulation body 1 that is adjacent to the second insulation body 2 protrudes to form a convex edge (not shown in the figure). One side of the second insulation body 2 that is adjacent to the first insulation body 1 indents to form a concave slot (not shown in the figure). The convex edge enters into the concave slot, and the convex edge matches the concave slot and there is a tolerance between the convex edge and the concave slot to achieve the same goal.

Figure 7:
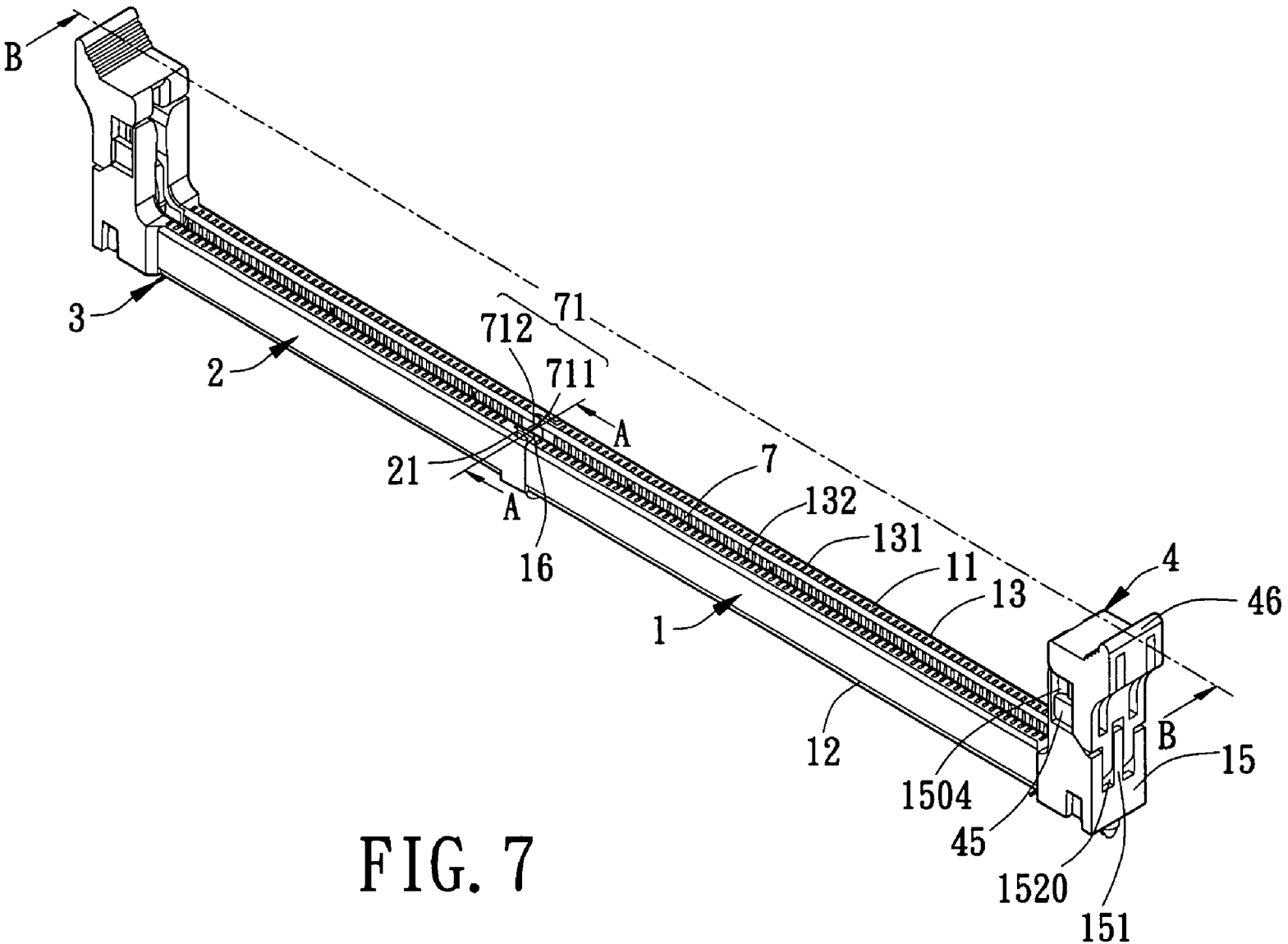
FIG. 7 is an assembly perspective view of the electrical connector of the present invention.
Figure 8A:
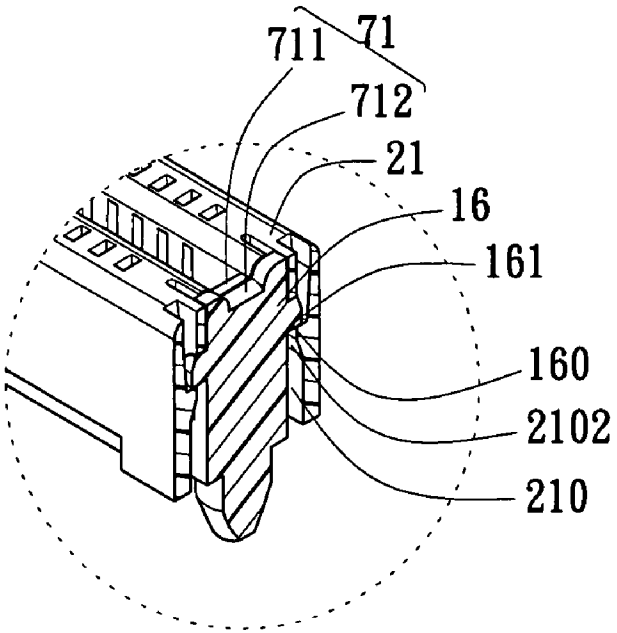
FIG. 8A is a drawing of partial enlargement illustrating the electrical connector as shown in FIG. 8.
Figure 8:
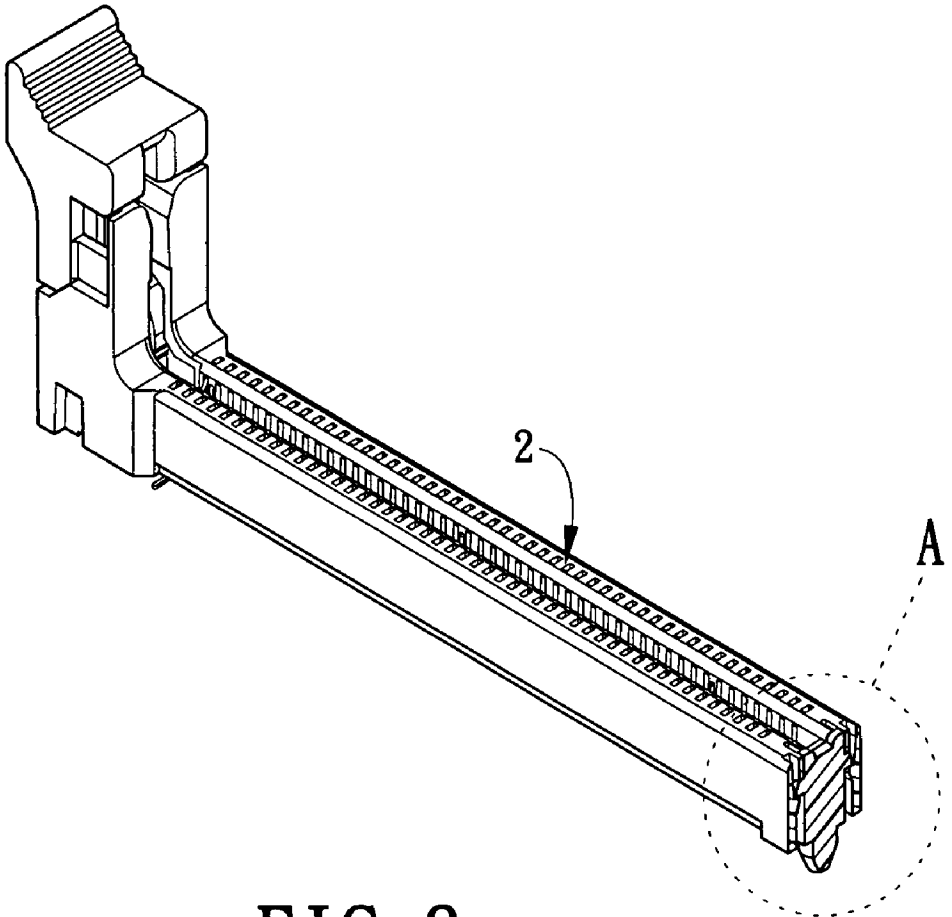
FIG. 8 is a cross-sectional diagram of the electrical connector of FIG. 7 along a line A-A.
Figure 9A:
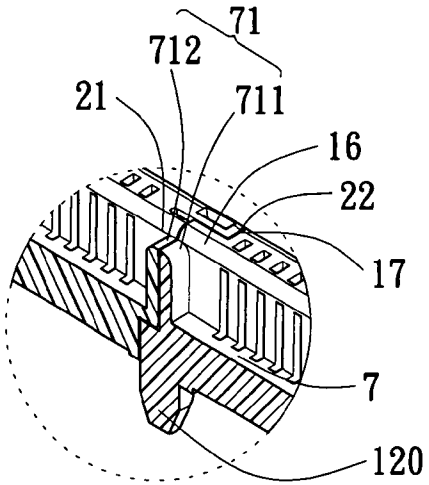
FIG. 9A is a drawing of partial enlargement illustrating the electrical connector as shown in FIG. 9.
Figure 9:
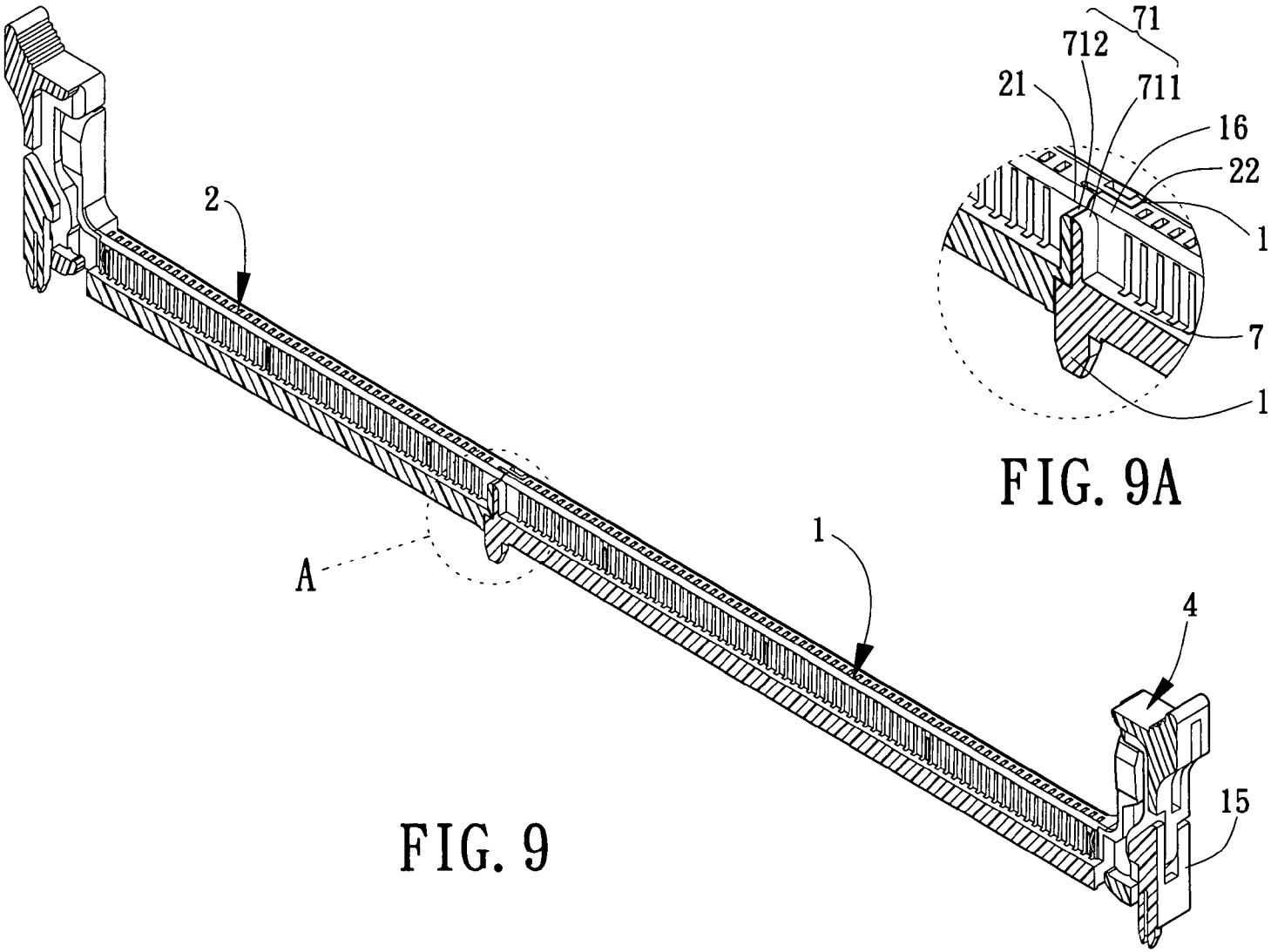
FIG. 9 is a cross-sectional diagram of the electrical connector of FIG. 7 along a line B-B.
Figure 10:
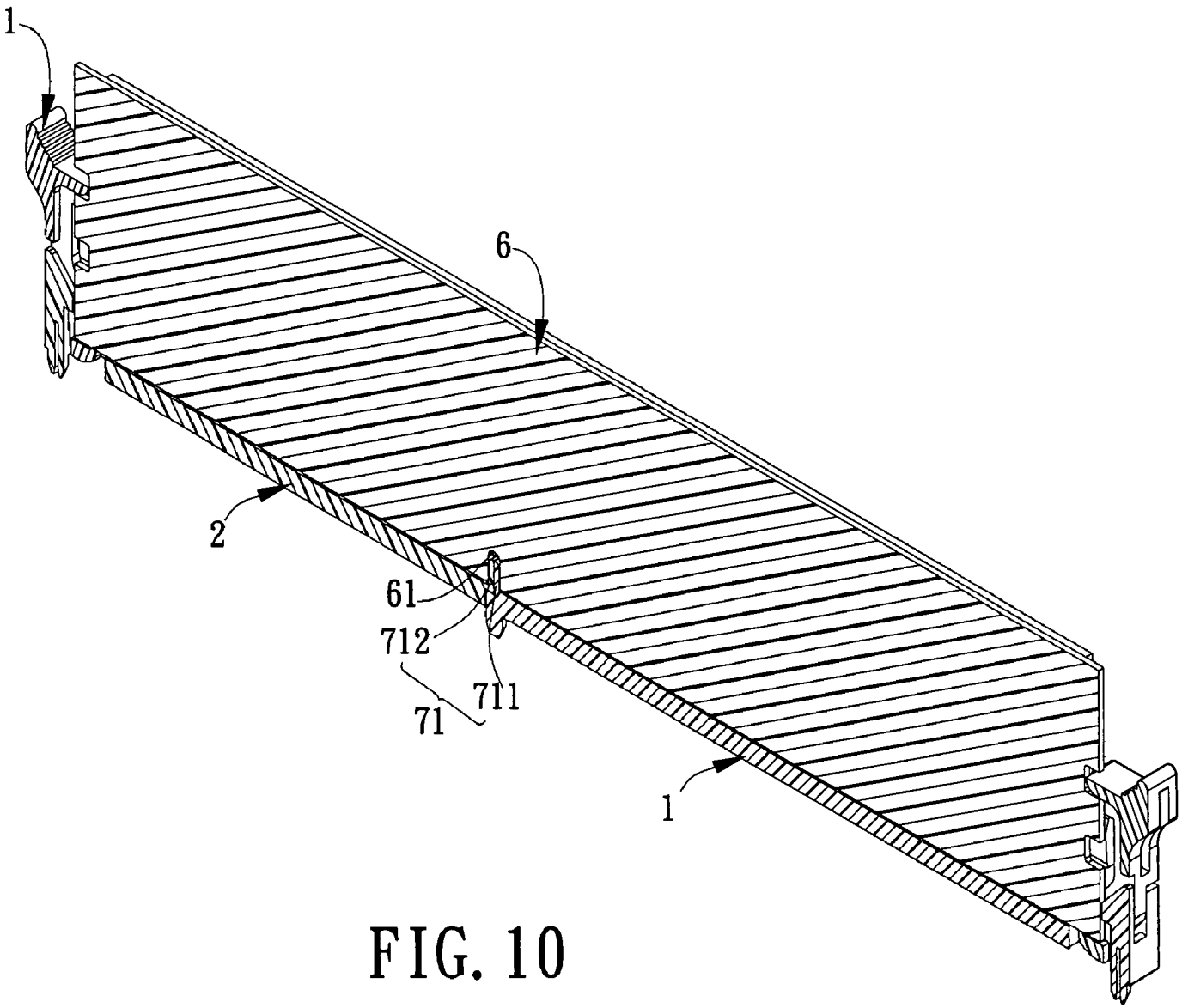
FIG. 10 is a cross-sectional diagram of the element in FIG. 9 being plugged into the electrical connector.
Figure 11:
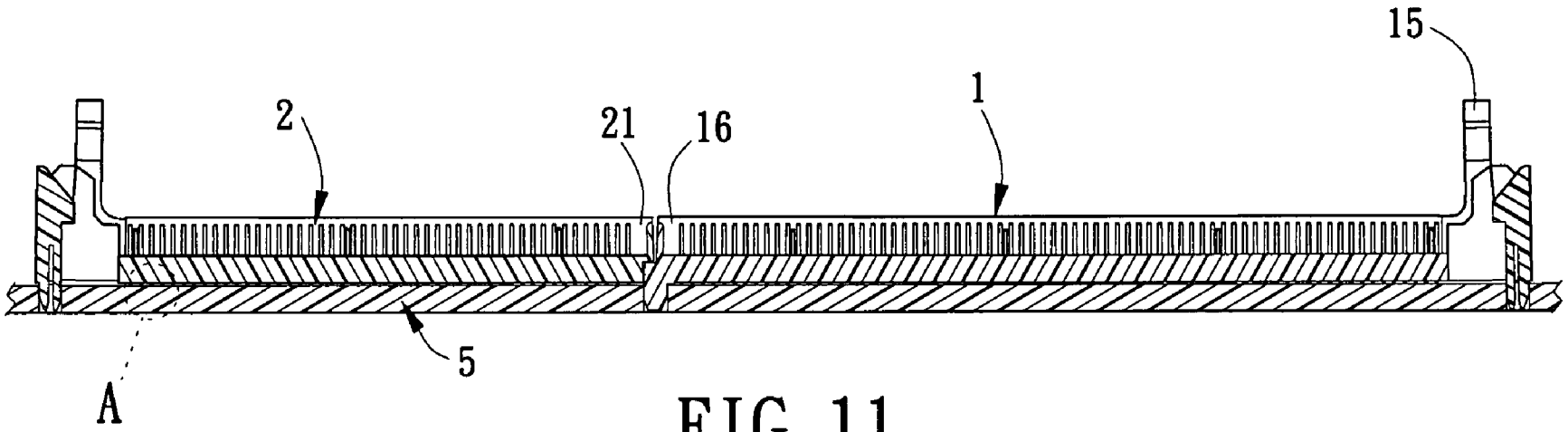
FIG. 11 is a schematic diagram of the warp when the electrical connector of the present invention is heated and soldered onto the circuit board.
Figure 11A:
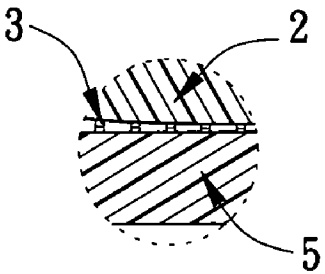
FIG. 11A is a drawing of partial enlargement illustrating the electrical connector as shown in FIG. 11.

Reference is made to FIGS. 7 and 10. The plugging slot 7 passes through the first insulation body 1 and the second insulation body 2 along the lengthwise direction for being plugged with the element 6. The plugging slot 7 forms a fool-proof block 71 at the connection location of the first insulation body 1 and the second insulation body 2. The fool-proof block 71 includes a first portion 711 and a second portion 712. The first portion 711 is located at the first pivoting portion 16 of the first insulation body 1. The second portion 712 is located at the second pivoting portion 21 of the second insulation body 2. The bottom of the element 6 that corresponds to the fool-proof block 71 has a key slot 61. When the key slot 61 matches the fool-proof block 71, the element 6 can be exactly (i.e. precisely) plugged into the electrical connector.

Reference is made to FIGS. 2, 2A, 11 and 11A. The conductive terminals 3 are respectively received in the corresponding receiving slots 14. The conductive terminals 3 are disposed into two rows and fastened the first insulation body 1 and the second insulation body 2. Each conductive terminal 3 has a holding portion 31, a soldering portion 32 bending downwards and extending from the one end of the holding portion 31, and a contacting portion 33 bending upwards and extending from another end of the holding portion 31. There is an interference between the holding portion 31 and the receiving slot 14 so that the holding portion 31 can be fastened in the receiving slot 14. The soldering portion 32 is mounted on the circuit board 5. The contacting portion 33 enters into the hole 132 to contact the element 6.

Figure 6:
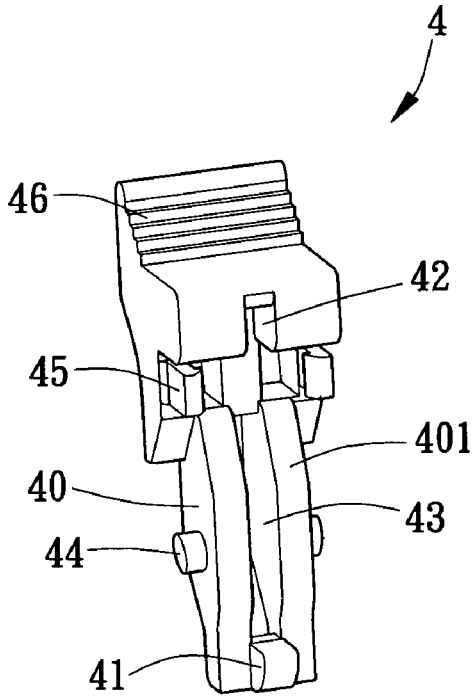
FIG. 6 is a perspective view of the ejecting device of the electrical connector of FIG. 2.

Reference is made to FIGS. 6 and 7. The ejecting device 4 is disposed pivotedly with the supporting frame 15 of the first insulation body 1 and the second insulation body 2, and includes a main body 40, an ejecting portion 41 and a wedging portion 42.

The ejecting portion 41 is located below the main body 40 for ejecting the element 6 out from the plugging slot 7.

The wedging portion 42 is located above the main body 40 for wedging the side edge of the element 6.

The main body 40 has two opposite side portions 401. The side portion 401 is installed in the receiving slot 1520 of the supporting frame 15. A slot hole 43 is formed between the opposite side portions 401 for receiving the positioning column 151.

The two side portions 401 respectively have a pivoting column 44. The pivoting column 4 is guided by the guiding slot 1502 to enter into and pivot with the pivoting hole 1502 of the first insulation body 1. Therefore, the ejecting device 4 uses the pivoting column 44 as a rotation shaft and can rotate in the supporting frame 15 within a specific angle.

The upper sides of the two side portions 401 respectively have a wedged portion 45. The wedged portion 45 is wedged in the wedging slot 1504 to fasten the ejecting device 4 in the supporting frame 15.

The upper side of the wedging portion 45 has a turning portion 46. When the turning portion 46 is turned outwards, the ejecting device 4 uses the pivoting column 44 as a rotation shaft to rotate outwards to release the element 6.

The assembly process of the electrical connector of the present invention is describes as following. First, the conductive terminals are installed and fastened in the receiving slot 14 of the first insulation body 1 and the second insulation body 2. Next, the first insulation body 1 and the second insulation body 2 are pivoted together. Finally, the ejecting device 4 is installed and fastened on the supporting frame 15 of the first insulation body 1 and the second insulation body 2.

The present invention has at least two adjacent insulation bodies on the electrical connector and one end of each insulation body is movably connected with the adjacent insulation body. While undergoing soldering process, such as when the soldering portions are mounted on the circuit board by the SMT, the relation position of the insulation bodies at the adjacent location is automatically adjusted according to the warp caused by high temperature to reduce the warp and deformation. Thereby, the soldering portion of each conductive terminal received in the insulation bodies can be soldered onto the circuit board well, such that the electrical connector is normally and electrically connected with the circuit board.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An electrical connector, used for electrically connecting an electronic element to a circuit board, comprising:

at least two adjacent insulation bodies, wherein one end of each insulation body pivots with the adjacent insulation body;

a plugging slot located on the insulation bodies for being plugged with the electronic element;

the plugging slot has a fool-proof block at the coupling location of the two adjacent insulation bodies, the fool-proof block includes a first portion and a second portion, the first portion and the second portion are located respectively at the adjacent ends of two adjacent insulation bodies, the first portion having at least one short shaft protruding laterally and the second portion being recessed from the adjacent ends and has at least one shaft slot formed therein to pivotally receive the short shaft therein; and a plurality of conductive terminals received in the insulation bodies, wherein each conductive terminal has a contacting portion that enters into the plugging slot, and a soldering portion electrically connecting with the circuit board.

2. The electrical connector as claimed in claim 1, wherein one of the two adjacent insulation bodies having the first portion has a first pivoting portion at adjacent sides thereof, and the other insulation body having the second portion has a second pivoting portion at adjacent sides thereof in correspondence with the first pivoting portion.

3. The electrical connector as claimed in claim 2, wherein the second pivoting portion indents to form a concave slot at one side of the insulation body thereof, at least one side of the concave slot has the shaft slot, the first pivoting portion protrudes to form a wedging portion at one side of the insulation body thereof to correspond with the concave slot, and at least one side of the wedging portion protrudes to form the short shaft to correspond with the shaft slot.

4. The electrical connector as claimed in claim 3, wherein one side of the surface of the insulation body indents to form a guiding slot along the concave slot for linking with the shaft slot.

5. The electrical connector as claimed in claim 4, wherein the guiding slot has a guiding slant surface.

6. The electrical connector as claimed in claim 1, wherein one of the insulation bodies has a blocking portion at the connection location of the two insulation bodies.

7. The electrical connector as claimed in claim 6, wherein the blocking portion extends from at least one of the insulation body.

8. The electrical connector as claimed in claim 1, wherein one side of at least one insulation body extends to form a supporting frame.

9. The electrical connector as claimed in claim 8, wherein at least one ejecting device is disposed pivotedly with the supporting frame of the insulation body.

10. An electrical connector for electrically connecting an electrical element to a circuit board, comprising:

a first insulation body and a second insulation body, the first and the second insulation body form a plugging slot for receiving the electrical element, wherein a first pivoting portion defined at one end of the first insulation body, the first pivoting portion has at least one protruded short shaft, wherein a second pivoting portion defined at one end of the second insulation body, the second pivoting portion concaves to form a shaft slot, wherein the short shaft is pivotably with the shaft slot; and a plurality of conductive terminals received in the insulation bodies, wherein each conductive terminal has a contacting portion and a soldering portion, the contacting portion enters into the plugging slot, the soldering portion electrically connects with the circuit board.

11. The electrical connector as claimed in claim 10, wherein the second pivoting portion further includes a concave slot.

12. The electrical connector as claimed in claim 11, wherein one side of the surface of the insulation body indents to form a guiding slot along the concave slot for linking with the shaft slot.

13. The electrical connector as claimed in claim 12, wherein the guiding slot has a guiding slant surface.

14. The electrical connector as claimed in claim 10, wherein at least one of the insulation bodies has a blocking portion at the connection location of the insulation bodies.

15. The electrical connector as claimed in claim 10, further including a fool-proof block in the plugging slot.

16. The electrical connector as claimed in claim 15, wherein at least two plugging portions of the insulation bodies have a fool-proof member at the coupling location of the adjacent insulation bodies, the fool-proof members of the insulation bodies jointly forming the fool-proof block.

17. The electrical connector as claimed in claim 10, wherein one end of at least one insulation body extends to form a supporting frame.

18. The electrical connector as claimed in claim 17, wherein at least one ejecting device is pivotably disposed on the supporting frame of the insulation body.

19. The electrical connector as claimed in claim 10, wherein the first pivoting portion further includes a wedging portion.

* * * * *